US008118692B2

(12) United States Patent
Day et al.

(10) Patent No.: US 8,118,692 B2
(45) Date of Patent: Feb. 21, 2012

(54) BASEBALL SWING DEVELOPMENT TOOL

(76) Inventors: Michael L. Day, Garland, TX (US); Dylan L. Day, Garland, TX (US)

( * ) Notice: Subject to any disclaimer, the term of this patent is extended or adjusted under 35 U.S.C. 154(b) by 0 days.

(21) Appl. No.: 12/661,258

(22) Filed: Mar. 12, 2010

(65) Prior Publication Data

US 2011/0224029 A1 Sep. 15, 2011

(51) Int. Cl.
*A63B 69/00* (2006.01)

(52) U.S. Cl. ..... 473/453; 473/422; 473/451

(58) Field of Classification Search ..... 473/422, 473/415; D21/720; 127/7, 50
See application file for complete search history.

(56) References Cited

U.S. PATENT DOCUMENTS 2,955,823 A * 10/1960 Chanko ..... 124/7
3,937,464 A * 2/1976 Zalewski ..... 473/428
3,999,753 A * 12/1976 Desilets et al. ..... 473/418
4,451,036 A * 5/1984 Sinclair et al. ..... 473/453
4,516,771 A * 5/1985 Nau ..... 473/453
D293,808 S * 1/1988 Durham et al. ..... D21/720
4,955,606 A * 9/1990 Leps ..... 124/50
5,042,802 A * 8/1991 Depianta ..... 124/50
5,066,010 A * 11/1991 Pingston ..... 473/451
5,097,985 A * 3/1992 Jones ..... 221/86
5,292,119 A * 3/1994 Norcross ..... 473/451
5,294,109 A * 3/1994 Meade ..... 124/54
D355,936 S * 2/1995 Boyd ..... D21/720
5,421,313 A * 6/1995 Strayer ..... 124/1
5,558,324 A * 9/1996 Jourdan ..... 124/83
6,296,581 B1 * 10/2001 Sever ..... 473/422
6,435,990 B1 * 8/2002 Bradley ..... 473/453
6,974,396 B2 * 12/2005 Mauer et al. ..... 473/417
7,300,365 B2 * 11/2007 Taylor ..... 473/451
7,819,763 B2 * 10/2010 Campbell et al. ..... 473/453

* cited by examiner

*Primary Examiner* — Mitra Aryanpour
(74) *Attorney, Agent, or Firm* — Thrasher Associates

(57) ABSTRACT

It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims. 37 CFR 1.27(b).

1 Claim, 1 Drawing Sheet

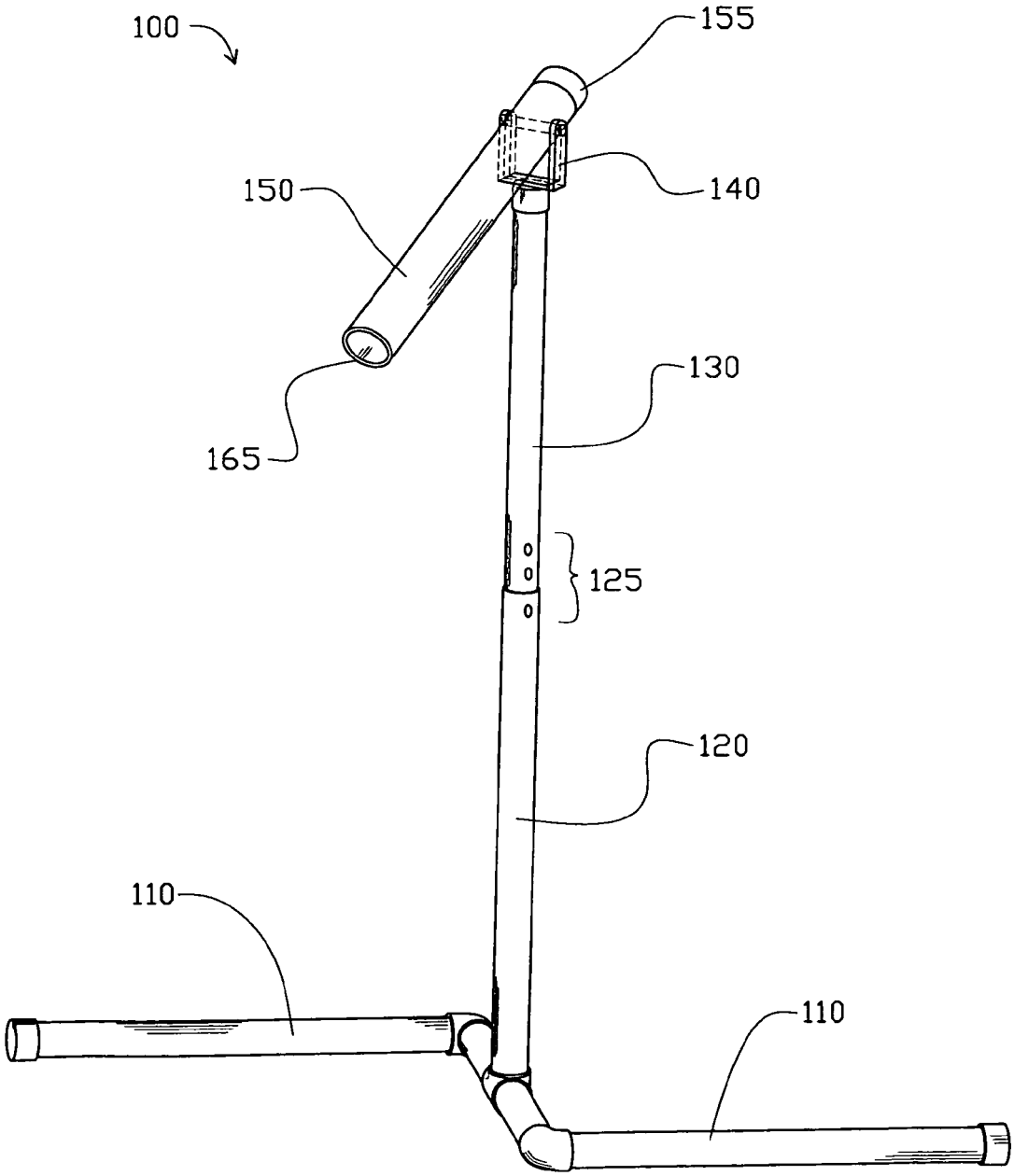
100
155
150
140
130
165
125
120
110
110

BASEBALL SWING DEVELOPMENT TOOL

FIELD OF INVENTION

The invention generally relates to sports training equipment, and more specifically to training equipment for the sport of baseball.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

According to many sports experts, hitting a baseball is the hardest thing to do in sports. The batter is trying to take a round bat and hit a round ball, squarely. The batter has a split second to make the decision of whether you are going to swing or not. Further, the batter must do all this while the ball may be spinning, changing speeds, and tailing away all at one moment. The best way to accomplish this task is to use a swing that covers the most area of the hitting zone so as to make square contact. Most hitting coaches define this as eliminating any holes in one's swing.

To maintain the "perfect" swing requires repetition of good habits developing proper muscle memory to perform each swing consistently. One way to develop this swing can be accomplished using a device that forces the individual to swing correctly each time. The present invention provides such a device.

BRIEF DESCRIPTION OF THE DRAWINGS

Various aspects of the invention, as well as an embodiment, are better understood by reference to the following detailed description. To better understand the invention, the detailed description should be read in conjunction with the drawings and tables, in which:

FIG. 1 illustrates an exemplary embodiment of the baseball swing guide.

EXEMPLARY EMBODIMENT OF A BEST MODE

Interpretation Considerations

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

DESCRIPTION OF THE DRAWINGS

Overview

The invention is a baseball swing guide (BSG). The BSG is a guide that is used to develop a baseball player's swing to develop better habits and produce better results. The Guide holds a players bat in proper swing starting position. The player places his bat's hitting end into a guide such as chute. The guide's height should be set to the proper position to achieve the desired results. The player practices swinging his bat while pulling it out of the guide in the process. The guide restricts the movement of the bat while the swing is being performed so as to allow the player to perform "perfect" swings.

Using this guide and performing many swings with the guide help the player develop the proper technique and muscle memory needed to perform the "perfect" swing consistently. The player should be able to perform the "perfect" swing while at the plate in baseball games. This swing will produce better hitting results for the player.

Shown in FIG. 1 is an exemplary embodiment of the Baseball Swing Guide 100. The base 110 is the support for the BSG 100. It adds support to keep the structure from falling over in average winds. Secured to the base is the support structure 115. The support structure comprises of a bottom support arm 120 and a top support arm 130. The top support arm is connected to a chute 150 via a bracket 140.

The Base 110 is a self-supporting. It is preferably tubes spread out to support the weight of the entire structure and add stability. The base may be as shown as tubes in L-Shapes opposite each other connected at the support point of the bottom arm 120. Another alternative base 110 may be a hollow tank that can be filled with a substance such as water or sand to add weight and additional stability. Another base is affixable in the ground such as a longer bottom arm 120 that can be buried in ground with or without concrete to add additional support. The benefit of the self-supporting arm is the mobility of the entire BSG. The Base 110 is not limited to being affixed to the ground; it may also be an affixed to an upright wall where the bottom support arm 120 stands horizontally rather than telescopically.

The bottom support arm 120 is connected to a top support arm 130 so that the overall height of the structure can be adjustable and fixed at several different heights, such as every 2 inches over about a 48-inch range. The support arms 120, 130 may be cylindrical in shape or polygonal. The adjustability can be created by many means. In FIG. 1, the top support arm 130 is smaller in size and fits inside of a hollow bottom support arm 120. The top support arm 130 has holes in the middle of its side (not shown but understood to one with ordinary skill in the art) that allows for pegs or a pin to slide into them and the hole 125 in the bottom support arm 120 and lock the BSG at a desired height. There are several holes at different heights, which can be lined up and secured. Alternatively, the telescoping height may be fixed at any height via a lock-nut or the supports are tight enough to stay at a the height needed.

The bracket 140 that connects the top support arm 130 to the chute 150 is secured in a fixed position to the top support arm 130. The chute 150 limits the movement of the baseball bat during the swing. The chute 150 fits securely around a standard baseball bat, 2¾ inch diameter.

The chute 150 is secured to the bracket 140 but can rotate in a vertical direction creating different angles, preferably ranging from 90 degrees to 0 degrees, of entry for a baseball bat into the entrance end 165 of the chute 150. Opposite of the entrance end is the counter balance end 155 which moves down when the entrance end 165 rotates up for different angles. The bracket 140 allows for the angle adjustability and can secure the chute at different angles. The adjustability is used for the same reason as the height adjustability in order to fulfill the needs of players of all sizes. The bracket can have the rotational adjustability secured with a spring, a pin, or counter balance weight added to the counter balance end 155.

Furthermore, though the invention has been described with respect to a specific preferred embodiment, many advantages, variations and modifications will become apparent to those skilled in the art upon reading the present application. It is therefore the intention that the appended claims and their equivalents be interpreted as broadly as possible in view of the prior art to include all such variations and modifications.

We claim:

1. A method of training a baseball batter to swing a bat effectively comprising the steps of:

providing a self-supporting base;

providing a support structure secured to the self-supporting base comprising:

a first support arm and a second support arm, the first support arm telescopically received within the second support arm in order to allow for height adjustment of the support structure, the first support arm is secured to the second support arm by a lock pin;

providing a hollow cylinder having an open end and a closed end, the hollow cylinder secured to the support structure via a pivot bracket, the hollow cylinder freely rotates such that the ends of the hollow cylinder move in opposite vertical directions while the hollow cylinder remains fixed to the support structure, wherein the hollow cylinder is secured to the support structure and the pivot bracket at a desired angle by the two pins;

providing a baseball or softball bat having a hitting portion and a handle portion;

placing the hitting portion into the open end of the hollow cylinder; and pulling the hitting portion out of the hollow cylinder, wherein the hollow cylinder restricts the movement of the baseball or softball bat while a bat swing is being performed so as to allow a player to perform the perfect bat swing.

* * * * *